United States Patent [19]

Roos

[11] 4,315,384

[45] Feb. 16, 1982

[54] COOLING DEVICE IN A GRINDING MACHINE

[75] Inventor: Bengt Roos, Lidköping, Sweden

[73] Assignee: Lidkopings Mekaniska Verkstads AB, Sweden

[21] Appl. No.: 124,816

[22] Filed: Feb. 26, 1980

[30] Foreign Application Priority Data

Apr. 20, 1979 [SE] Sweden ..... 7903471

[51] Int. Cl.[3] ..... B24B 55/02

[52] U.S. Cl. ..... 51/267; 51/103 R

[58] Field of Search ..... 51/266, 267, 103 R

[56] References Cited

U.S. PATENT DOCUMENTS 2,730,845 1/1956 Ernst ..... 51/103 R 3,325,949 6/1967 Fisher ..... 51/267

FOREIGN PATENT DOCUMENTS 713270 11/1941 Fed. Rep. of Germany ..... 51/267

*Primary Examiner*—Harold D. Whitehead

*Attorney, Agent, or Firm*—Eugene E. Renz, Jr.

[57] ABSTRACT

The invention relates to a device for cooling a rotating grinding wheel and a work piece contacting the grinding wheel in a grinding machine. The device comprises a flushing mouthpiece (6) with two openings (13, 14) facing each other for supplying a cooling agent to the grinding spot. The openings are situated on a line parallel to the axis of the grinding wheel above the grinding spot, and cooling agent can be supplied in such great amounts that a homogeneous mass (7) of cooling agent is established between the openings, which mass contacts the ground surface of the work piece and the envelope surface of the grinding wheel.

5 Claims, 3 Drawing Figures

COOLING DEVICE IN A GRINDING MACHINE

BACKGROUND AND SUMMARY OF THE INVENTION

The present invention relates to a device for cooling a rotating grinding wheel with a mainly horizontal axis and a grinding envelope surface and a work piece contacting the grinding wheel in a grinding machine.

For obtaining a high production rate in a grinding machine it is desirable that the speed of the grinding wheel in relation to the work piece be as high as possible. A high grinding wheel speed, however, causes a high temperature to develop in the contact between the grinding wheel and the work piece. An excessively high temperature results in a fast wear of the grinding wheel and deterioration of the ground surface of the work piece. In order to avoid too high a temperature rise the grinding wheel and the work piece therefore have to be cooled with a suitable cooling agent during the grinding operation. To this end it is earlier known, in order to ensure that the cooling agent penetrates to the contact between grinding wheel and work piece, to arrange collecting plates for the cooling agent around the grinding spot and to supply the cooling agent, e.g. water, in such great amount that a mainly homogeneous mass of cooling agent is situated in a space which is limited by the plates and the mutually contacting surfaces of the grinding wheel and the work piece. Such a device is shown in e.g. the Swedish patent publication No. 7314281-2, publication number 390.912.

The plates comprised in the known device are comparatively bulky and sometimes constitute an obstacle for the accessibility of the grinding spot. Plates with a given shape can in general not be used together with work pieces of different dimensions, so that when the dimension of the work piece is changed, the plates must also be replaced, as a rule.

The object of the present invention is to provide a cooling device by which a good cooling of the work piece and the grinding wheel is secured, which device is simple and inexpensive to produce, which can easily be adapted to work pieces of different sizes, which allows a good access to the grinding spot, and which does not affect the environment negatively.

This is achieved, according to the invention, by that the device shows the characterizing features stated in the appended Claim 1.

BRIEF DESCRIPTION OF THE DRAWINGS

In the following the invention is more closely described with reference to the accompanying drawing, in which.

DESCRIPTION OF THE PREFERRED EMBODIMENT

Figure 1:
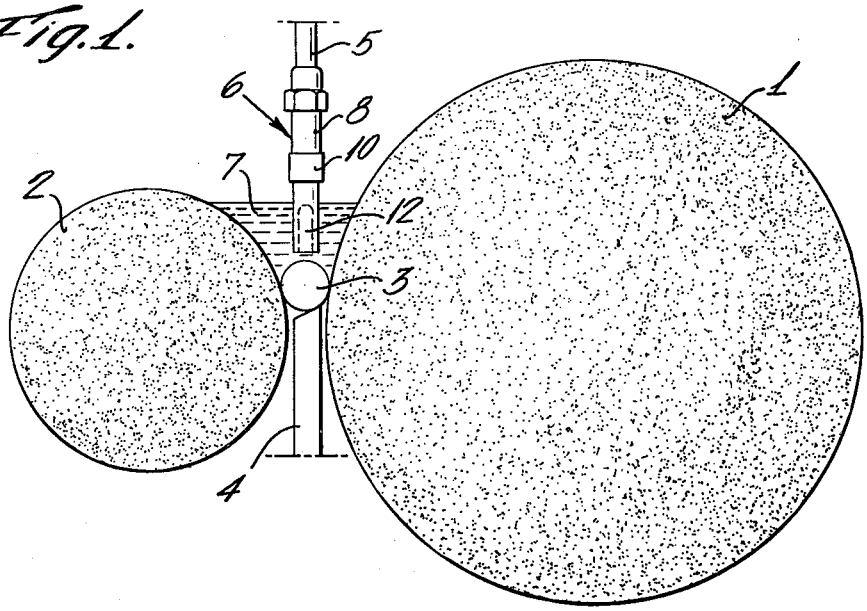
FIG. 1 shows a view of the grinding spot and surrounding members in a centerless grinding machine provided with a device according to an embodiment of the invention.

FIG. 1 shows a grinding wheel 1 and a regulating wheel 2 in a centerless grinding machine in which a work piece 3 is ground. The work piece also rests on a support 4. Means for the supply of a cooling agent are provided in the wedge-shaped space between the grinding wheel and the regulating wheel, the bottom of the space being constituted by the work piece. A cooling agent is supplied via a conduit 5 to a flushing mouthpiece 6, through which the cooling agent is supplied in such a great amount that a mainly homogeneous mass 7 of cooling agent is developed and maintained in said wedge-shaped space above the contact of the work piece with the grinding wheel. The mass of cooling agent is partly limited by and contacts the ground surface of the work piece and the envelope surface of the grinding wheel, whereby a good cooling effect is obtained even when the grinding wheel rotates with a high speed, since the air layer which exists close to the periphery of the grinding wheel and which follows its rotation and normally causes cooling problems because it prevents the access of cooling agent at the contact between the grinding wheel and the work piece cannot penetrate the mass of cooling agent, which thus directly contacts the work piece and the grinding wheel also at their common contact area, where the heat develops.

A homogeneous mass of cooling agent can be obtained by designing the flushing mouthpiece so that it comprises two openings for the supply of cooling agent arranged at a distance from and facing each other above the contact of the work piece with the grinding wheel and on a line mainly parallel to the axis of the grinding wheel, and by supplying cooling agent in sufficient amounts and with a sufficient pressure. In a centerless grinding machine with normal dimension it is suitable to supply e.g. cooling water with a normal water pipe pressure through a $1\frac{1}{2}''$ pipe (designation 5 in FIG. 1). By the existence of two cooling agent currents directed towards each other, there is no need for collecting plates, and still the immediate spreading of the cooling agent sideways outside of the grinding spot is prevented. If necessary the flushing mouthpiece can be easily adapted to fit work pieces with different dimensions by being adjustable vertically so that the openings can always be situated close to the surface of the work piece.

Figure 2:
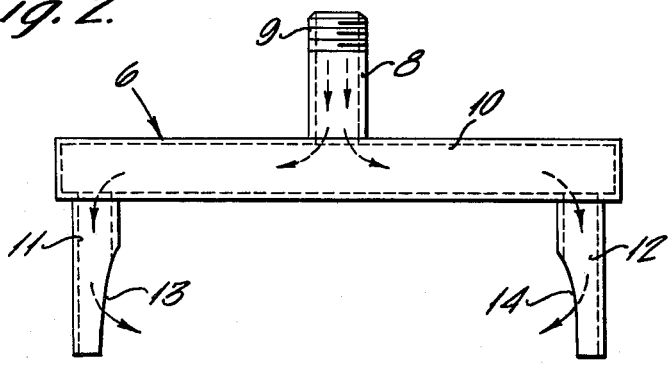
FIG. 2 shows a view in a greater scale of a detail of the invention in a plane parallel to the axis of the grinding wheel.
Figure 3:
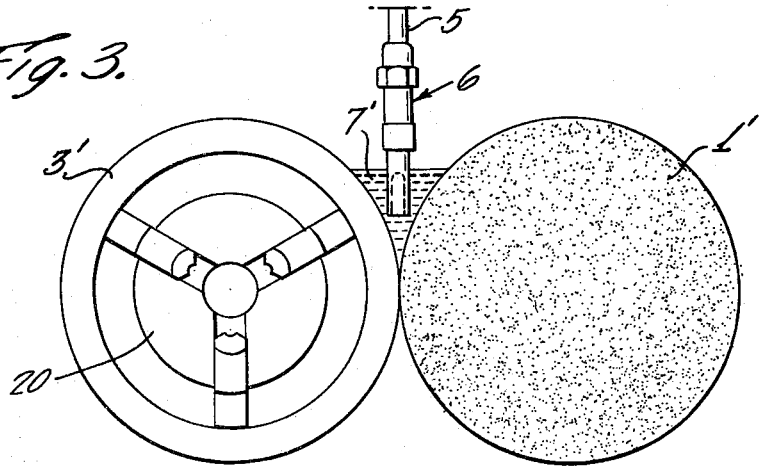
FIG. 3 is a view of a grinding apparatus wherein the workpiece is supported in a chuck.

A suitable embodiment of the flushing mouthpiece is shown in FIG. 2. A pipe end 8 is connectible to a cooling agent conduit by a threaded portion 9. The pipe end is mounted on a horizontal tube 10 which is closed at both ends and provided with downwardly directed tubes 11, 12 arranged at a distance from each other and closed at their bottoms. At the lower end portions of the tubes, openings 13, 14 are arranged to face each other. A cooling agent can flow through the pipes as shown by arrows. By placing the openings 13, 14 between the grinding wheel and the regulating wheel close to the surface of the underlying work piece a mainly homogeneous mass of cooling agent is built up in the area between the openings. The openings are suitably placed in connection to the end surfaces of the grinding wheel and the regulating wheel, so that the entire grinding surface of the grinding wheel is contacted by the cooling agent. The work pieces in a centerless grinding machine are cylindrical and may have different lengths. As a rule they are fed axially through the machine without mutual axial distance so that the homogeneous mass of cooling agent during grinding is limited at the bottom by a continuous row of work pieces, whereby it is prevented from immediate by flowing down between the grinding wheel and the regulating wheel.

The invention is useful also together with machines other than centerless grinding machines. For example, it is possible to place the flushing mouthpiece in the wedge-shaped space 7' between the grinding wheel and the work piece in a grinding machine without a regulating wheel, where the work piece 3' is e.g. held in a chuck or other fixing means 20. Therewith the work piece may possibly have a noncylindrical shape.

I claim:

1. In a grinding apparatus comprising a grinding wheel rotatable about a generally horizontal axis and having a peripheral envelope surface for contacting and grinding a workpiece, means for cooling the grinding wheel and workpiece including means supplying a cooling agent under pressure to the grinding zone comprising an elongated manifold connected to a cooling agent supply source and extending generally parallel to the axis of the grinding wheel and a pair of spaced discharge nozzles confronting one another disposed above the contact of the grinding wheel and workpiece and radially outwardly of the envelope surface of the grinding wheel to supply cooling agent to the grinding zone in such amounts and with such a pressure that a mainly homogeneous mass of cooling agent is established between said nozzle openings, the mass contacting the ground surface of the workpiece and the envelope surface of the grinding wheel.

2. In a grinding apparatus comprising a grinding wheel rotatable about a generally horizontal axis and having a peripheral envelope surface for contacting and grinding a workpiece, backup means having a peripheral envelope surface adjacent said grinding wheel for contacting said workpiece, means for cooling the grinding wheel and workpiece including means for supplying a cooling agent under pressure to the grinding zone comprising an elongated manifold connected to a cooling agent supply source and extending generally parallel to the axis of the grinding wheel and a pair of spaced discharge nozzles confronting one another disposed above the contact of the grinding wheel and workpiece and radially outwardly of the envelope surface of the grinding wheel to supply cooling agent to the grinding zone in such amounts and with such a pressure that a mainly homogeneous mass of cooling agent is established between said nozzle openings, the mass contacting the ground surface of the workpiece and the envelope surface of the grinding wheel and backup means adjacent said grinding wheel whereby said cooling agent accumulates in a generally v-shaped trough between said backup means and grinding wheel.

3. In a grinding apparatus as claimed in claim 2 wherein said backup means comprises a regulating wheel forming in combination with said grinding wheel a centerless grinding machine.

4. In a grinding apparatus as claimed in claim 2 wherein said backup means comprises a chuck for supporting the workpiece.

5. In a grinding apparatus as claimed in claim 2 wherein the mass of cooling agent extends along the entire axial extension of the envelope surface of the grinding wheel.

* * * * *